US008881640B2

(12) United States Patent
Errington et al.

(10) Patent No.: US 8,881,640 B2
(45) Date of Patent: Nov. 11, 2014

(54) ARCHITECTURAL MESH FORCED ENTRY SYSTEM

(75) Inventors: Trevor J. Errington, Kingston, PA (US); James J. Mitchell, Seaford, DE (US)

(73) Assignee: Cambridge International Inc., Cambridge, MD (US)

( * ) Notice: Subject to any disclaimer, the term of this patent is extended or adjusted under 35 U.S.C. 154(b) by 0 days.

(21) Appl. No.: 13/556,777

(22) Filed: Jul. 24, 2012

(65) Prior Publication Data

US 2013/0186264 A1 Jul. 25, 2013

Related U.S. Application Data

(60) Provisional application No. 61/511,384, filed on Jul. 25, 2011.

(51) Int. Cl.
*F41H 5/24* (2006.01)
*F41H 5/26* (2006.01)
*E06B 9/01* (2006.01)

(52) U.S. Cl.
CPC .. *E06B 9/01* (2013.01); *F41H 5/24* (2013.01); *E06B 2009/015* (2013.01)
USPC ..... 89/36.04

(58) Field of Classification Search
CPC ..... F41H 5/013; F41H 5/24; F41H 7/035; F42D 5/045; E06B 9/02
USPC ..... 160/330, 378; 109/17, 10, 45; 52/507, 52/473; 49/56; 428/14; 89/36.04, 40.03; 248/208; 16/86.2, 236, 90
See application file for complete search history.

(56) References Cited

U.S. PATENT DOCUMENTS

| | | | | |
|---|---|---|---|---|
| 1,567,446 | A * | 12/1925 | McClure | 160/391 |
| 2,498,716 | A * | 2/1950 | Seide | 160/378 |
| 3,126,332 | A * | 3/1964 | Salete | 209/408 |
| 4,800,947 | A * | 1/1989 | Loomis | 160/368.1 |
| 4,922,988 | A * | 5/1990 | Loomis | 160/368.1 |
| 5,832,666 | A * | 11/1998 | Flack et al. | 49/67 |
| 6,057,029 | A * | 5/2000 | Demestre et al. | 428/221 |
| 6,718,705 | B2 * | 4/2004 | Emek | 52/204.69 |
| 8,156,698 | B2 * | 4/2012 | Colton et al. | 52/202 |
| 8,191,606 | B2 * | 6/2012 | Edlin | 160/378 |
| 8,365,492 | B2 * | 2/2013 | Frest et al. | 52/473 |
| 8,365,803 | B2 * | 2/2013 | Schoenheit et al. | 160/330 |
| 2005/0090338 | A1 * | 4/2005 | Scarpa, III | 473/492 |
| 2006/0075699 | A1 * | 4/2006 | Messick et al. | 52/202 |
| 2006/0090862 | A1 * | 5/2006 | Messick, Jr. | 160/330 |
| 2008/0190278 | A1 * | 8/2008 | Martin | 89/36.07 |

FOREIGN PATENT DOCUMENTS

WO 2009/011853 A1 1/2009

OTHER PUBLICATIONS

European Search Report dated Sep. 6, 2013 for Application No. 12177671.0.

* cited by examiner

*Primary Examiner* — Samir Abdosh
*Assistant Examiner* — John D Cooper
(74) *Attorney, Agent, or Firm* — Buchanan Ingersoll & Rooney PC

(57) ABSTRACT

A forced entry system for a framed opening including a bracket assembly secured to the framed opening; a mounting tube including a saddle, the saddle being secured to the bracket assembly; and a mesh panel secured by the mounting tube to cover the framed opening.

9 Claims, 8 Drawing Sheets

ARCHITECTURAL MESH FORCED ENTRY SYSTEM

CROSS-REFERENCE TO RELATED APPLICATION

This application claims priority under 35 U.S.C. §119(e) to Provisional Application Ser. No. 61/511,384, filed Jul. 25, 2011, the entire contents of which are hereby incorporated by reference.

FIELD OF THE INVENTION

The present invention is directed to a forced entry system, and more particularly, to an architectural mesh forced entry system configured to resist forced entry into framed openings including doors and windows.

BACKGROUND OF THE INVENTION

One of the most common ways of gaining access to a locked premises is through a forced entry. Forced entry is generally defined as being an unauthorized entry accomplished by the use of force upon the physical components of the premises, generally doors, windows, and wall panels of any type, louvers, escape hatches and protective window grilles. With respect to doors, such forced entry usually takes the form of battering on the door adjacent to the door lock assembly, or adjacent to the center hinge of the door, usually applied by an intruder with one or more solid kicks delivered to the door. Since most entry doors are fabricated from soft wood, as are the strike and hinge jambs, they are not constructed to withstand such force. The bolt of the lock assembly, or the door, or the strike jamb split and break apart and thus give the intruder access to the premises. With respect to a window, attempts to force an entry may be made by breaking the glass panel of the window and/or cutting a hole in a window grille sufficiently large, not necessarily for a person to gain entry, but large enough for a person to place an incendiary device or explosive within the premises.

It would be desirable to have available options to prevent such unauthorized entry while still maintaining an aesthetically pleasing appearance.

SUMMARY OF THE INVENTION

A forced entry system for a framed opening comprising a bracket assembly secured to the framed opening; a mounting tube including a saddle, said saddle being secured to said bracket assembly; and a mesh panel secured by the mounting tube to cover the framed opening.

BRIEF DESCRIPTION OF THE DRAWING FIGURES

These and other objects, features, and advantages of the invention will become more readily apparent to those skilled in the art upon reading the following detailed description, in conjunction with the appended drawings in which.

DETAILED DESCRIPTION OF THE INVENTION

Figure 1:
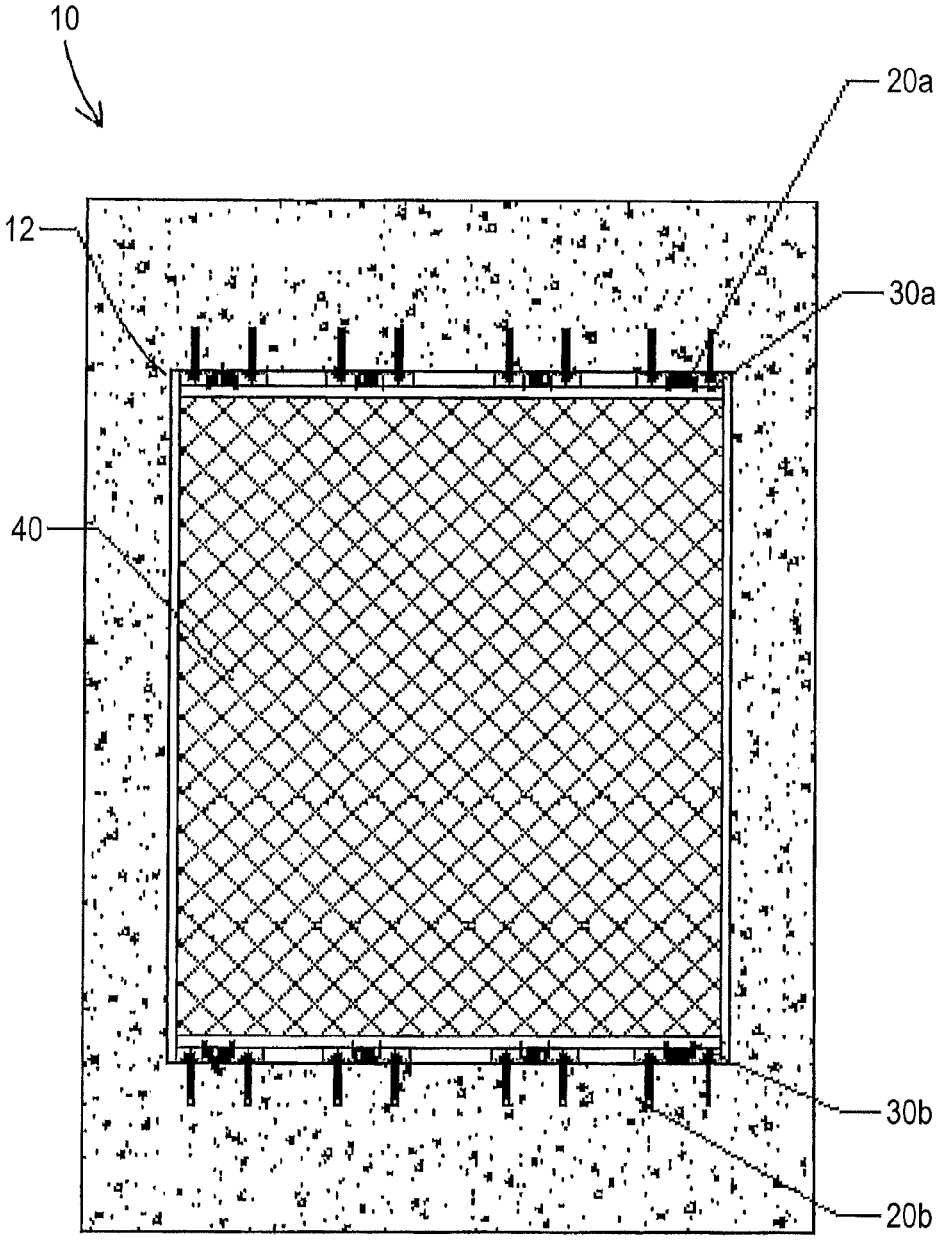
FIG. 1 is a front elevational view of a forced entry system according to the invention.
Figure 2:
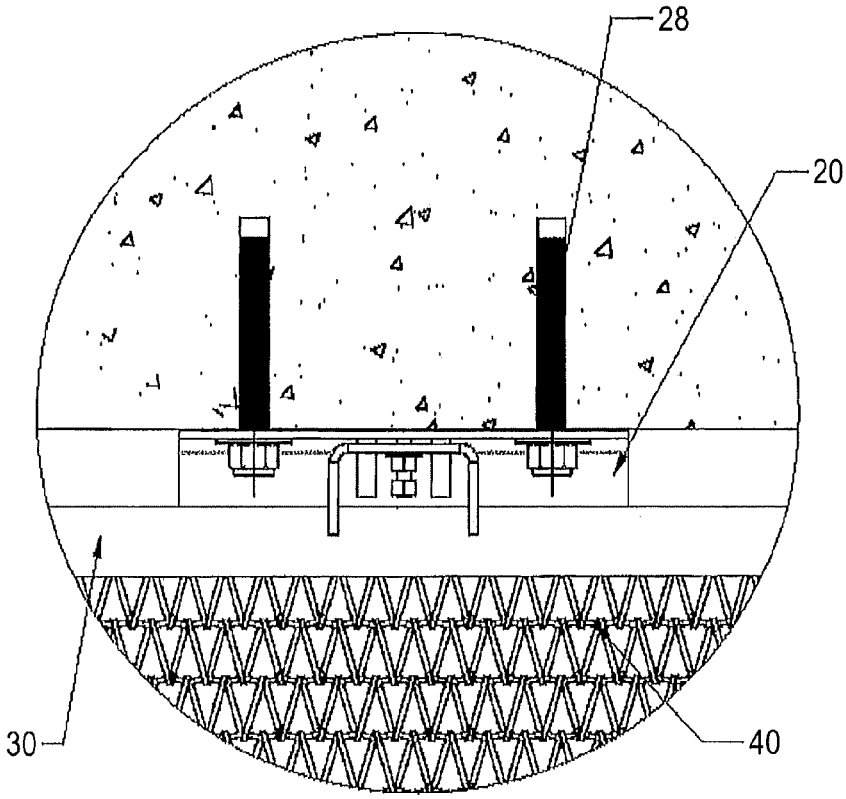
FIG. 2 is an enlarged view of a portion of the forced entry system of the invention as shown in FIG. 1.

Referring to FIGS. 1 and 2, the forced entry system 10 of the invention includes a bracket assembly 20 configured to be fastened to concrete, steel, or other framing material defining a framed opening 12 such as for a door, window or the like, a mounting tube 30 secured to the bracket assembly 20, and a mesh panel 40 mounted within the opening 12 by the mounting tube 30. As shown, the invention preferably includes an upper and lower bracket assembly 20*a*, 20*b* and an upper and lower mounting tube 30*a*, 30*b*, thereby securing the mesh panel 40 along the top and bottom of the opening 12.

Figure 3:
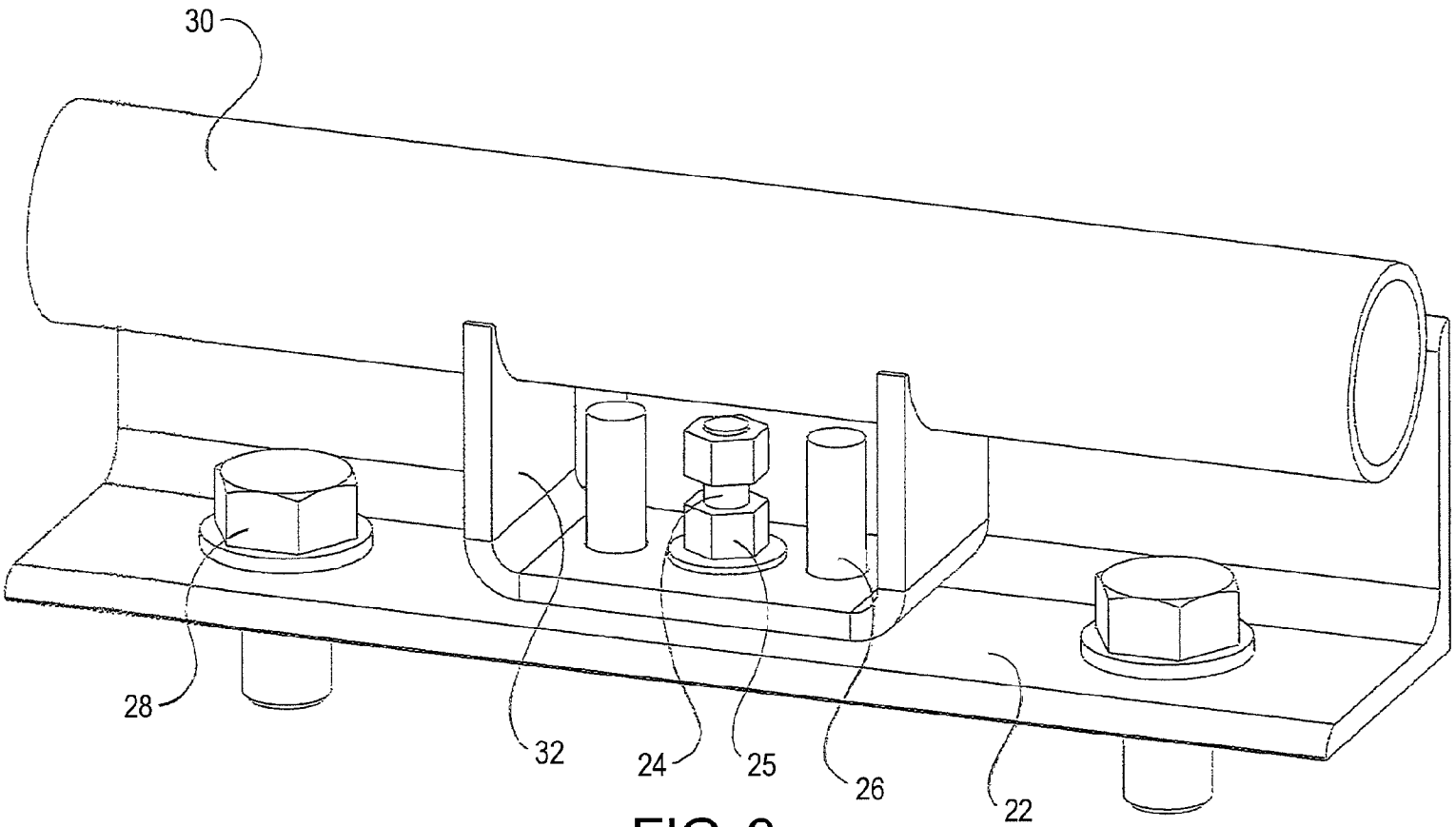
FIG. 3 is a perspective view of the bracket assembly and mounting tube of the invention.
Figure 4:
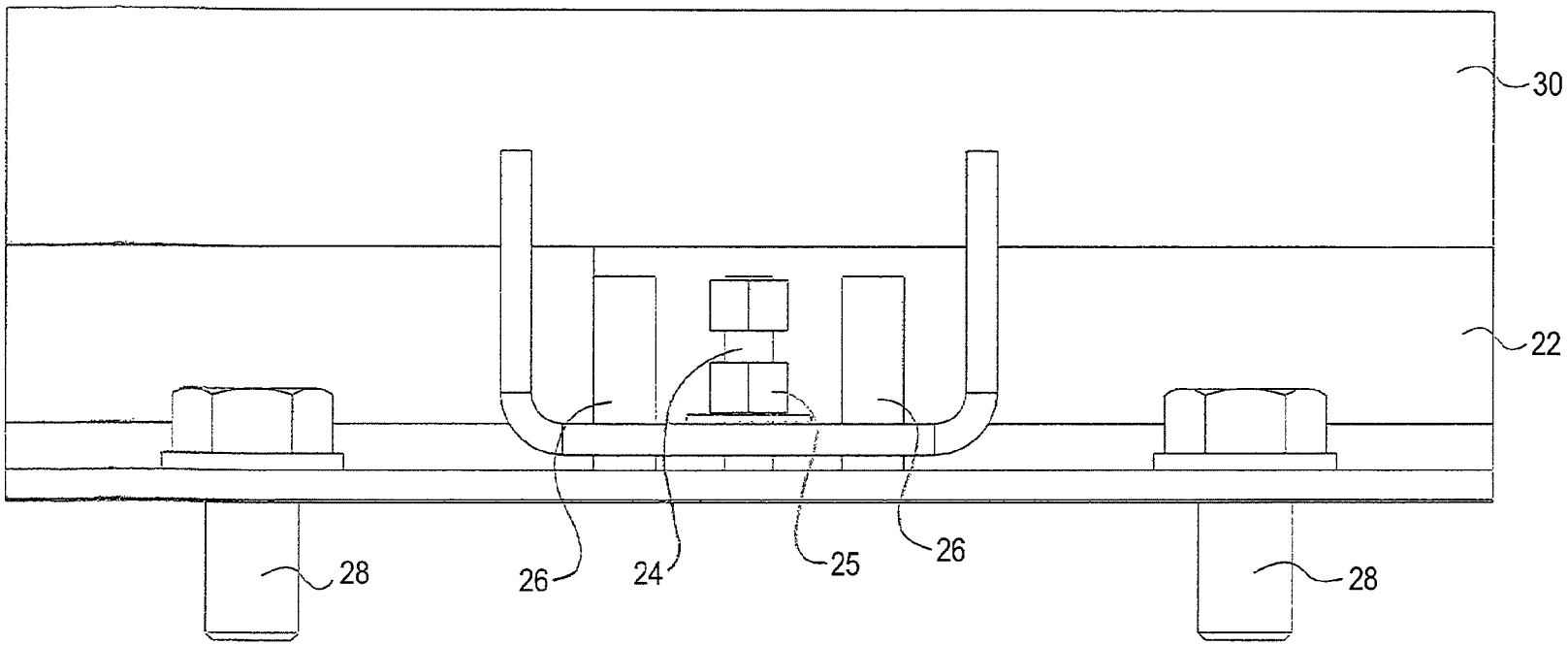
FIG. 4 is a rear elevational view of the bracket assembly and mounting tube of the invention.
Figure 5:
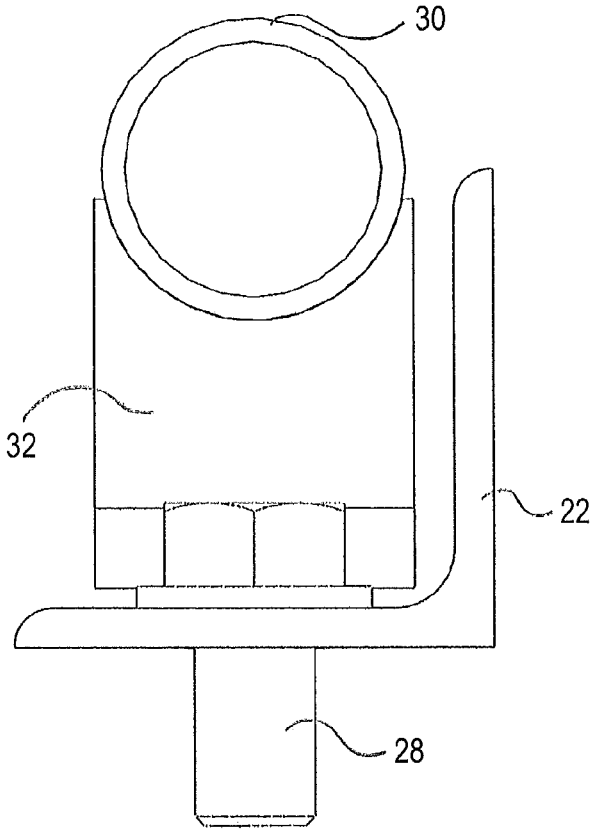
FIG. 5 is a side elevational view of the bracket assembly and mounting tube of the invention.

As shown in FIGS. 3-5, bracket assembly 20 comprises a base plate 22 preferably defined by an angle bracket, and most preferably fabricated from a 3"×3"×¼" angle, T316 stainless steel angle, T304 stainless steel angle, or the like. The base plate 22 is attached to the framed opening 12, preferably with either anchors or bolts 28 depending upon the material of the opening 12, i.e., concrete anchors such as epoxy anchors are preferred for a concrete framed opening and bolts can be used for a steel framed opening. The bracket assembly 20 further includes a tension screw or stud 24 and/or one or more guide rods 26. Tension stud 24 is preferably a ⅜" stainless all thread tension stud and guide rods 26 are preferably defined by ½" guide rods. As shown in FIG. 1, the base plate 22 is best attached to the framed opening 12 at the top and bottom thereof.

Figure 6:
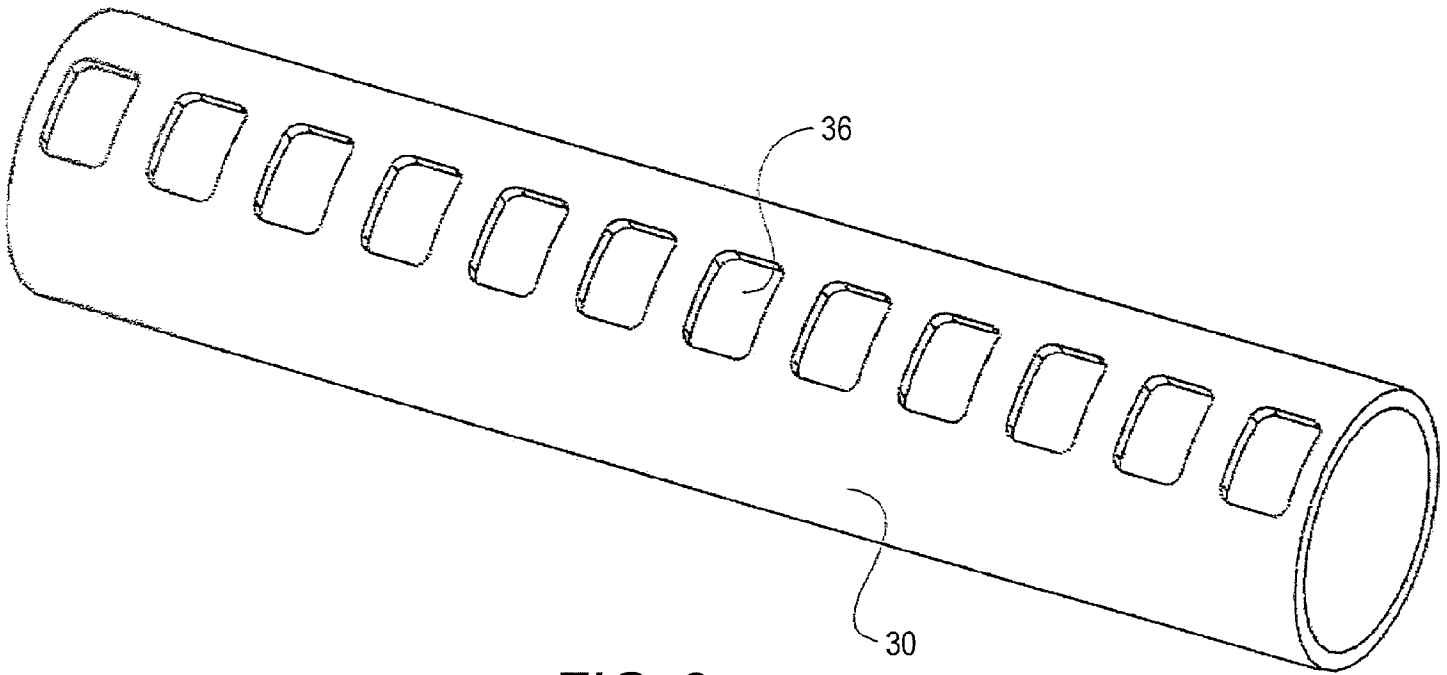
FIG. 6 is a top perspective view of the mounting tube of the invention.

Referring also to FIG. 6, the mounting tube 30 has apertures 36 (not shown in FIGS. 2-5) cut along the length thereof which are sized to accept the spirals of the architectural mesh panel 40, as described below. A straight rod (not shown) is inserted into the uppermost/lowermost mesh spiral that is disposed inside the tube 30 in order to hold the mesh panel 40 in place. Preferably, a 6 gage straight rod can be used for this purpose and caps (not shown) can be attached to the ends of the tube 30 to thereby secure the straight rod inside the tube. Each mounting tube 30 preferably comprises a 1½" schedule 40 tube (1.90 O.D.) made from T316 or T304 stainless steel, although other sizes and materials can certainly be utilized depending upon the particular installation.

Each mounting tube 30 further comprises a tube saddle 32 which allows the mesh panel 40 to be attached to the base plate 22 of the bracket assembly 20. The saddles 32 are welded onto the mounting tubes 30 and fit onto the tension stud 24 and guide rods 26 preferably provided on the base plate 22. The saddles 32 can be fabricated from ¼" T316 or T304 stainless steel, or the like. Cover plates (not shown) also made from stainless steel can be welded to the front side of the saddles to prevent tools from being inserted and the tension screws being deliberately loosened by a would-be intruder.

Figure 7:
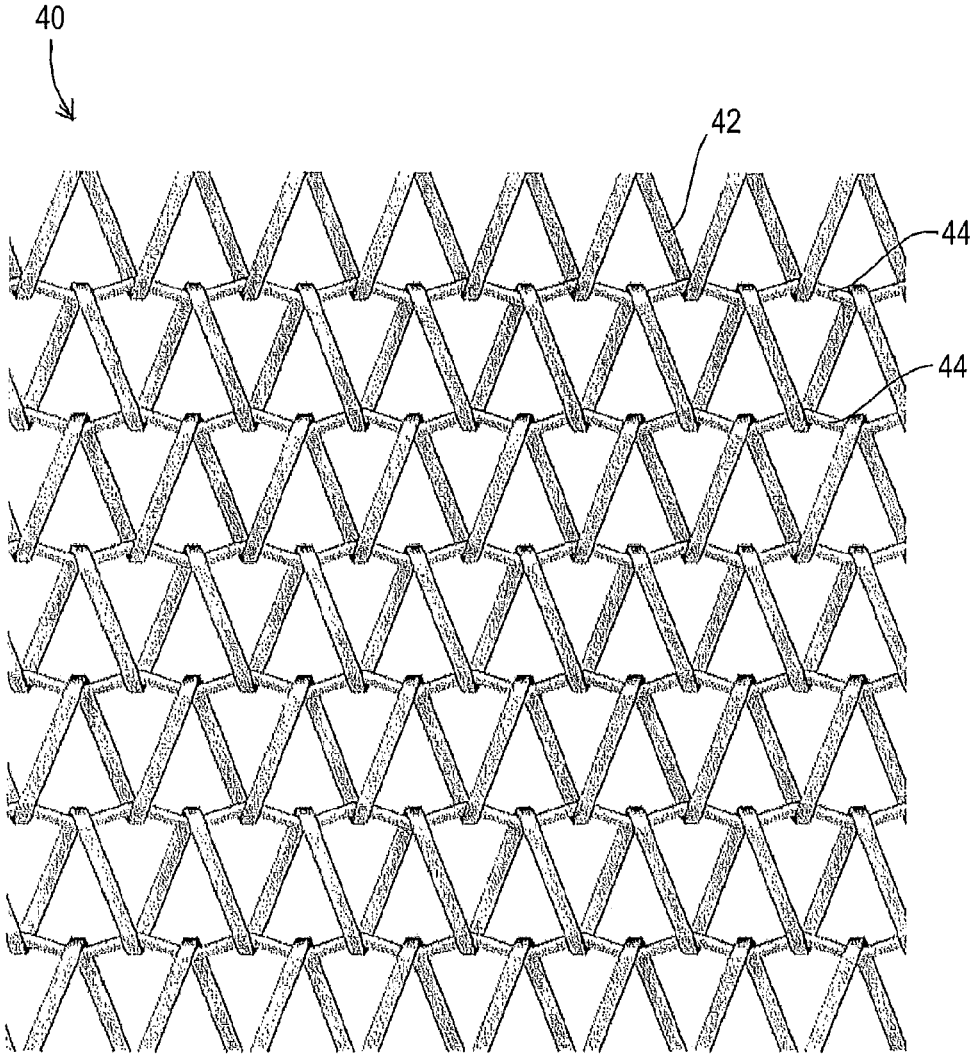
FIG. 7 is an elevational view of the mesh panel of the invention.
Figure 8:
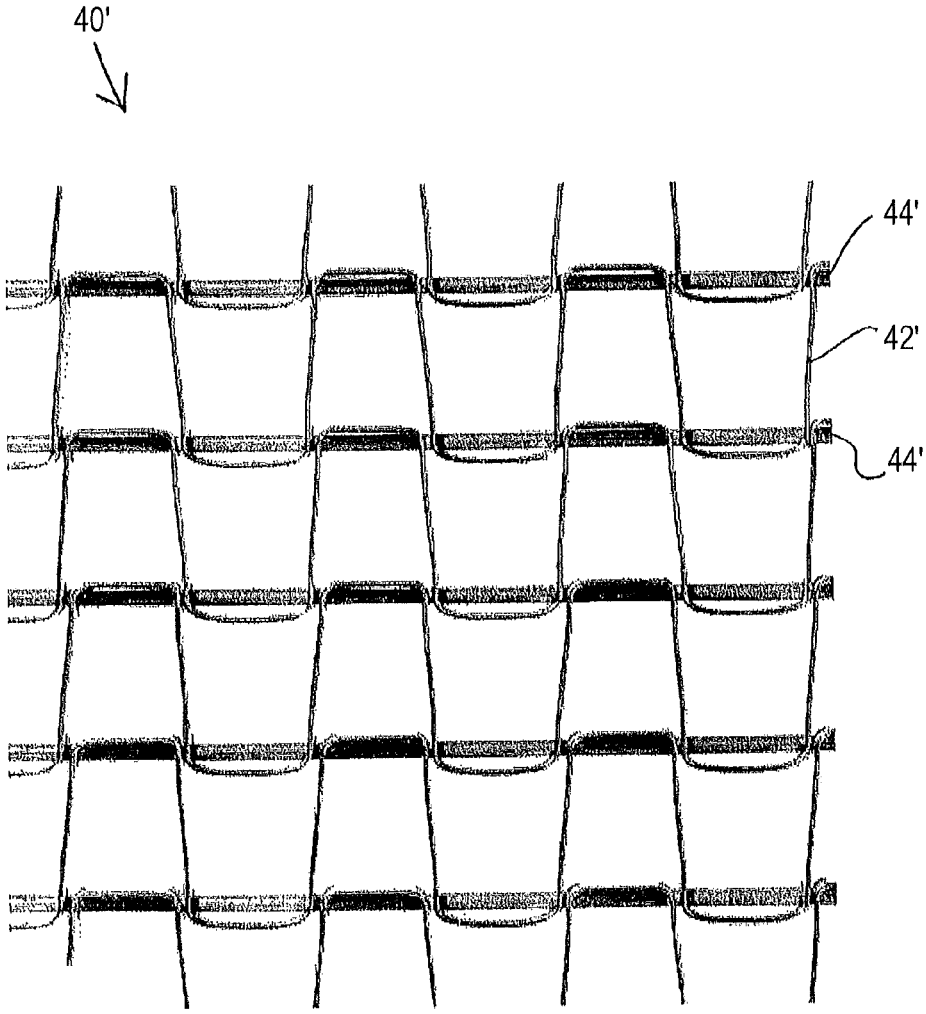
FIG. 8 is an elevational view of an alternate mesh panel according to a further embodiment of the invention.

The mesh panel 40 shown in FIG. 7, and an alternate mesh panel 40' shown in FIG. 8 preferably comprise a mesh fabric, and more particularly, an architectural mesh. In assembling the mesh panel shown in FIG. 7, a single helically-wound spiral wire 42 is associated with two connector or crimp rods 44 positioned to be sequentially adjacent in the vertical direction of the architectural mesh panel 40 and to thereby define a spiral unit. The combination of a helically-wound spiral wire and two associated connector rods defines a plurality of widthwise side-by-side open recesses. The flexible mesh can be of any weave, as desired for the particular application. That is, the open area per square foot of mesh can be configured as desired by varying 1) the spread, or loops/foot in the widthwise direction; 2) the pitch, or spirals/foot; 3) the wire gauge of the connecting rods; and/or 4) the wire gauge from which the spiral units are formed. The mesh panel 40 can be woven from stainless steel wire, such as, for example, 10 gage (0.135) T316 or T304 stainless steel wire. The architectural mesh panel 40 may also be woven from a combination of spiral wire units of two or more different metals, for example, brass and stainless steel, a combination selected from stainless steel, aluminum, brass, bronze and copper, or the mesh may be woven using spiral wire units that are made from the same material. Similarly, all of the wires may be the same size or shape, or they may have different characteristics.

The horizontal crimp rods 44 are inserted into the woven spirals 42 to join the individual spirals together into a panel 40. The ends of the crimp rods are welded to make the assembly permanent. The mesh panel 40 is tensioned by tightening the lock nut 25 on the tension screw 24 during installation, and the spirals thus nest in the crimp rod grooves to maintain the desired taught panel shape.

The mesh panel 40' shown in FIG. 8 is similar to the round wire mesh pattern shown in FIG. 7, except that it comprises a flat wire style mesh having a flat wire link 42' associated with two connector rods 44' positioned to be sequentially adjacent in the vertical direction of the architectural mesh panel 40'. The mesh panel 40' can also be of any weave, as desired for the particular application, as described above.

The round wire pattern of mesh shown in FIG. 7 and the flat wire pattern of mesh shown in FIG. 8 are examples of possible mesh that can be utilized in the forced entry system 10. One skilled in the art will appreciate that not only other weaves, but other mesh patterns as well, could of course be utilized to achieve the desired strength.

One of the advantages of architectural mesh forced entry system 10, particularly when used behind the glass of a window, is its ability to allow light and ventilation into open spaces and that it can be removed for cleaning, if necessary.

The above-described architectural mesh forced entry system 10 is designed to meet the standard established by the Department of State to resist forced entry into doors and windows as outlined in SD-STD-01.01, Revision G dated Apr. 30, 1993, the contents of which are hereby incorporated by reference. The architectural mesh forced entry system 10 is designed to meet or exceed the 5 minute protection level outlined in said above-noted standard. More particularly, in testing the forced entry system 10, two men supplied with crowbars, sledge hammers and wire cutters failed within 5 minutes to break down the mesh forced entry system 10 or cut a hole large enough in the mesh panel 40 to place a "package" within the premises. The forced entry system 10 is also designed for low level blast mitigation in the event that a package, such as an explosive device, is detonated in the vicinity thereof.

While the present invention has been described with respect to a particular embodiment of the present invention, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the claims.

What is claimed is:

1. A forced entry system for a framed opening comprising:

at least one bracket assembly configured to be secured to the framed opening, said bracket assembly comprising an angle bracket, the angle bracket having a base plate and an angled portion, the base plate defining a bracket longitudinal axis and the angled portion extending in a direction substantially orthogonal to the base plate;

a mounting tube defining a tube longitudinal axis and including a saddle, said saddle being permanently secured to the mounting tube, said saddle being positioned by at least one guide rod of said bracket assembly, and said saddle being secured to said bracket assembly by a tension screw, the tension screw extending in a direction substantially parallel to the angled portion of said bracket assembly, the guide rod extending in a direction substantially parallel to the tension screw;

a tension screw extending through said base plate and said saddle, the tension screw securing said saddle to said base plate; and a mesh panel secured by the mounting tube to cover the framed opening;

wherein the bracket longitudinal axis is parallel to the tube longitudinal axis.

2. The forced entry system of claim 1, wherein said base plate is secured to the framed opening with anchors or bolts.

3. The forced entry system of claim 1, wherein said mounting tube comprises a plurality of apertures for receiving said mesh panel.

4. The forced entry system of claim 1, wherein said saddle is welded to said mounting tube.

5. The forced entry system of claim 1, wherein said mesh panel comprises a mesh fabric.

6. The forced entry system of claim 1, wherein said mesh fabric comprises a plurality of helically wound spiral wire and a plurality of connector rods interconnecting the helically wound spiral wires.

7. The forced entry system of claim 1, wherein said saddle is orthogonal to both the angled portion and the base plate of the angle bracket.

8. A blast mitigation system for a framed opening comprising:

at least one bracket assembly secured to the framed opening;

a mounting tube defining a tube longitudinal axis and including a saddle, said saddle being permanently secured to the mounting tube, said saddle being positioned by at least one guide rod of said bracket assembly, and said saddle being secured to said bracket assembly by a tension screw; and a mesh panel secured by the mounting tube to cover the framed opening;

wherein said at least one bracket assembly comprises an angled base plate with a base portion and an angled portion, the base portion defining a bracket longitudinal axis and the angled portion extending in a direction orthogonal to the base portion, the tension screw and the guide rod extending in a direction parallel to the angled portion of said bracket assembly, the bracket longitudinal axis being parallel to the tube longitudinal axis;

wherein said base plate is secured to the framed opening with anchors or bolts; and wherein said mounting tube comprises a plurality of apertures for receiving said mesh panel.

9. The blast mitigation system of claim 8, wherein said saddle is orthogonal to both the angled portion and the base portion of the angle bracket.

* * * * *